US009835978B2

(12) United States Patent
Castle et al.

(10) Patent No.: US 9,835,978 B2
(45) Date of Patent: Dec. 5, 2017

(54) NOTCHED END SEAL FOR AN ELECTROPHOTOGRAPHIC IMAGE FORMING DEVICE

(71) Applicant: LEXMARK INTERNATIONAL, INC., Lexington, KY (US)

(72) Inventors: Scott Richard Castle, Lexington, KY (US); Richard Louis Goin, Lexington, KY (US); Brad Edward Mattingly, Lawrenceburg, KY (US); Benjamin Erich Kant, Lexington, KY (US); Joseph Andrew Schaefer, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/240,239

(22) Filed: Aug. 18, 2016

(65) Prior Publication Data

US 2017/0082949 A1 Mar. 23, 2017

Related U.S. Application Data

(60) Provisional application No. 62/221,799, filed on Sep. 22, 2015.

(51) Int. Cl.
*G03G 15/08* (2006.01)

(52) U.S. Cl.
CPC ..... *G03G 15/0881* (2013.01); *G03G 15/0812* (2013.01); *G03G 15/0817* (2013.01); *G03G 15/0898* (2013.01); *G03G 2221/1648* (2013.01)

(58) Field of Classification Search
CPC ..... G03G 15/0881; G03G 15/0812; G03G 15/0817; G03G 15/0898; G03G 2221/1648
See application file for complete search history.

(56) References Cited

U.S. PATENT DOCUMENTS 5,057,868 A * 10/1991 Sekino ..... G03G 15/0898 399/105
5,212,521 A * 5/1993 Ogawa ..... G03G 15/0898 399/264
5,389,732 A * 2/1995 Sekino ..... G03G 15/0898 399/103
5,475,467 A 12/1995 Watanabe et al.
5,488,462 A * 1/1996 Ishikawa ..... G03G 15/0815 399/103

(Continued)

FOREIGN PATENT DOCUMENTS

EP 2657785 A2 10/2013

OTHER PUBLICATIONS

Extended European search report dated Feb. 10, 2017 for European Patent Application No. 16190078.2.

*Primary Examiner* — Ryan Walsh
(74) *Attorney, Agent, or Firm* — Justin M. Tromp

(57) ABSTRACT

An end seal for an electrophotographic image forming device according to one example embodiment includes an elastomeric body having a blade seal portion for sealing against a rear surface of a doctor blade and a curved rotary seal portion that extends from a bottom end of the blade seal portion for sealing against an outer surface of a rotatable developer roll. The end seal includes a cutout in an inner axial side of the body positioned at a point where the rotary seal portion and the blade seal portion meet.

18 Claims, 8 Drawing Sheets

(56) References Cited

U.S. PATENT DOCUMENTS

| | | | | |
|---|---|---|---|---|
| 5,870,651 | A * | 2/1999 | Shimada | G03G 15/0817 399/102 |
| 6,341,206 | B1 * | 1/2002 | Yamaguchi | G03G 15/0817 399/103 |
| 6,487,383 | B2 | 11/2002 | Buchanan et al. | |
| 6,553,195 | B2 | 4/2003 | Korfhage et al. | |
| 6,591,074 | B1 * | 7/2003 | Michlin | G03G 15/0812 399/106 |
| 6,985,683 | B2 | 1/2006 | Foster et al. | |
| 6,996,353 | B2 * | 2/2006 | Schell | G03G 15/0898 399/103 |
| 7,239,824 | B2 * | 7/2007 | Fukuta | G03G 15/0817 399/103 |
| 7,539,438 | B2 * | 5/2009 | van Leipsig | G03G 21/0011 399/102 |
| 7,561,820 | B2 | 7/2009 | Gayne et al. | |
| 7,623,807 | B2 | 11/2009 | Carter, II et al. | |
| 7,627,265 | B2 | 12/2009 | Gayne et al. | |
| 8,099,012 | B2 | 1/2012 | Askren et al. | |
| 8,116,657 | B2 | 2/2012 | Kant et al. | |
| 8,644,725 | B2 | 2/2014 | Brown et al. | |
| 8,886,080 | B2 | 11/2014 | Allen et al. | |
| 8,948,649 | B2 | 2/2015 | McCoy et al. | |
| 2002/0141777 | A1 * | 10/2002 | Kamimura | G03G 15/0817 399/103 |
| 2004/0001727 | A1 | 1/2004 | Akutsu | |
| 2006/0204273 | A1 * | 9/2006 | Kawai | G03G 15/0817 399/103 |
| 2007/0034099 | A1 | 2/2007 | Gayne et al. | |
| 2007/0071489 | A1 * | 3/2007 | Nakaya | G03G 15/0812 399/103 |
| 2013/0259514 | A1 * | 10/2013 | McCoy | G03G 15/0817 399/103 |
| 2016/0259271 | A1 * | 9/2016 | Ooyoshi | G03G 15/0817 |

* cited by examiner

NOTCHED END SEAL FOR AN ELECTROPHOTOGRAPHIC IMAGE FORMING DEVICE

CROSS REFERENCES TO RELATED APPLICATIONS

This application claims priority to U.S. Provisional Patent Application Ser. No. 62/221,799, filed Sep. 22, 2015, entitled "End Seal for an Electrophotographic Image Forming Device," the content of which is hereby incorporated by reference in its entirety.

BACKGROUND

1. Field of the Disclosure

The present disclosure relates generally to image forming devices and more particularly to a notched end seal for an electrophotographic image forming device.

2. Description of the Related Art

Various seals are used in electrophotographic printers to prevent toner from leaking between the printer's components. For example, toner leakage may occur from the gaps between a developer roll that supplies toner to a photoconductive drum of the electrophotographic printer, a doctor blade in contact with the developer roll and the housing of a developer unit that holds the developer roll and the doctor blade. Seals may be provided to effectively close the gaps between these components to prevent toner leakage. For example, a J-shaped seal may be used at each axial end of the developer roll to prevent toner from leaking out of the junction between the developer roll, the doctor blade and the housing of the developer unit.

The J-shaped seal may include small grooves formed in a helical pattern on a surface of the seal that contacts the developer roll. The grooves are formed between small ribs on the surface of the seal. As the developer roll rotates against the surface of the seal, the grooves direct toner away from the axial ends of the developer roll and back into a toner reservoir in the housing. However, toner may tend to accumulate between the developer roll and the surface of the seal over time due to inefficiencies of the grooves. The accumulated toner may eventually push the seal away from the developer roll creating a toner leakage path past the seal. One approach to the problem of toner accumulation between the developer roll and the seal is to increase the force of the seal against the developer roll in order to resist the seal pushing away from the developer roll. However, the increased force increases the friction between the seal and the developer roll thereby risking damage to the seal, the developer roll and/or the toner due to excessive force or heat. Another approach to the problem of toner accumulation between the developer roll and the seal is to increase the width of the seal in the axial dimension of the developer roll in order to provide added sealing. However, the axial lengths of the developer roll and the doctor blade typically must be increased in order to accommodate the larger seals and maintain the ability to print the desired page width. The longer developer roll and doctor blade may, in turn, increase the overall size of the developer unit contrary to consumer preferences for smaller components.

Accordingly, a seal that reduces the occurrence or effect of toner accumulation between the developer roll and the surface of the seal is desired.

SUMMARY

An end seal for an electrophotographic image forming device according to one example embodiment includes an elastomeric body having a blade seal portion for sealing against a rear surface of a doctor blade and a curved rotary seal portion that extends from a bottom end of the blade seal portion for sealing against an outer surface of a rotatable developer roll. The end seal includes a cutout in an inner axial side of the body positioned at a point where the rotary seal portion and the blade seal portion meet.

An end seal for an electrophotographic image forming device according to another example embodiment includes an elastomeric body. The body includes a blade seal portion shaped to seal against a planar rear surface of a doctor blade. The body includes a curved rotary seal portion that extends from a bottom end of the blade seal portion and is shaped to seal against an outer surface of a rotatable developer roll. The end seal includes a cutout through the body at an inner axial side of the body. The cutout is positioned at a bottommost portion of the blade seal portion and a topmost portion of the rotary seal portion such that the bottommost portion of the blade seal portion and the topmost portion of the rotary seal portion have a smaller width across a sealing face of the end seal than a portion of blade seal portion directly above the cutout and a portion of the rotary seal portion directly below the cutout.

In some embodiments, a sealing face of the blade seal portion includes a plurality of grooves that run along a longitudinal dimension of the body and a sealing face of the rotary seal portion includes a plurality of grooves that run transverse to the longitudinal dimension of the body. In some embodiments, the cutout has a rectangular cross-sectional shape. In other embodiments, the cutout has a partial circular cross-sectional shape or a triangular cross-sectional shape. In some embodiments, a height of the cutout along a longitudinal dimension of the body is greater than a width of the cutout across a sealing face of the end seal.

A developer unit for an electrophotographic image forming device according to one example embodiment includes a housing and a developer roll mounted on the housing. The developer roll is rotatable relative to the housing about an axis of rotation. The developer roll includes an outer surface. A doctor blade is mounted on the housing. The doctor blade is in contact with the outer surface of the developer roll along an axial dimension of the developer roll. The developer unit includes an end seal having a body. The body has a blade seal portion sandwiched between a first interface of the housing and a rear surface of the doctor blade at an end of the doctor blade. The body has a curved rotary seal portion sandwiched between a second interface of the housing and an outer surface of the developer roll at an axial end of the developer roll. The body has an inner axial side and an outer axial side relative to the developer roll. The end seal includes a cutout in the inner axial side of the body. The cutout is positioned at a point where the doctor blade contacts the outer surface of the developer roll.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
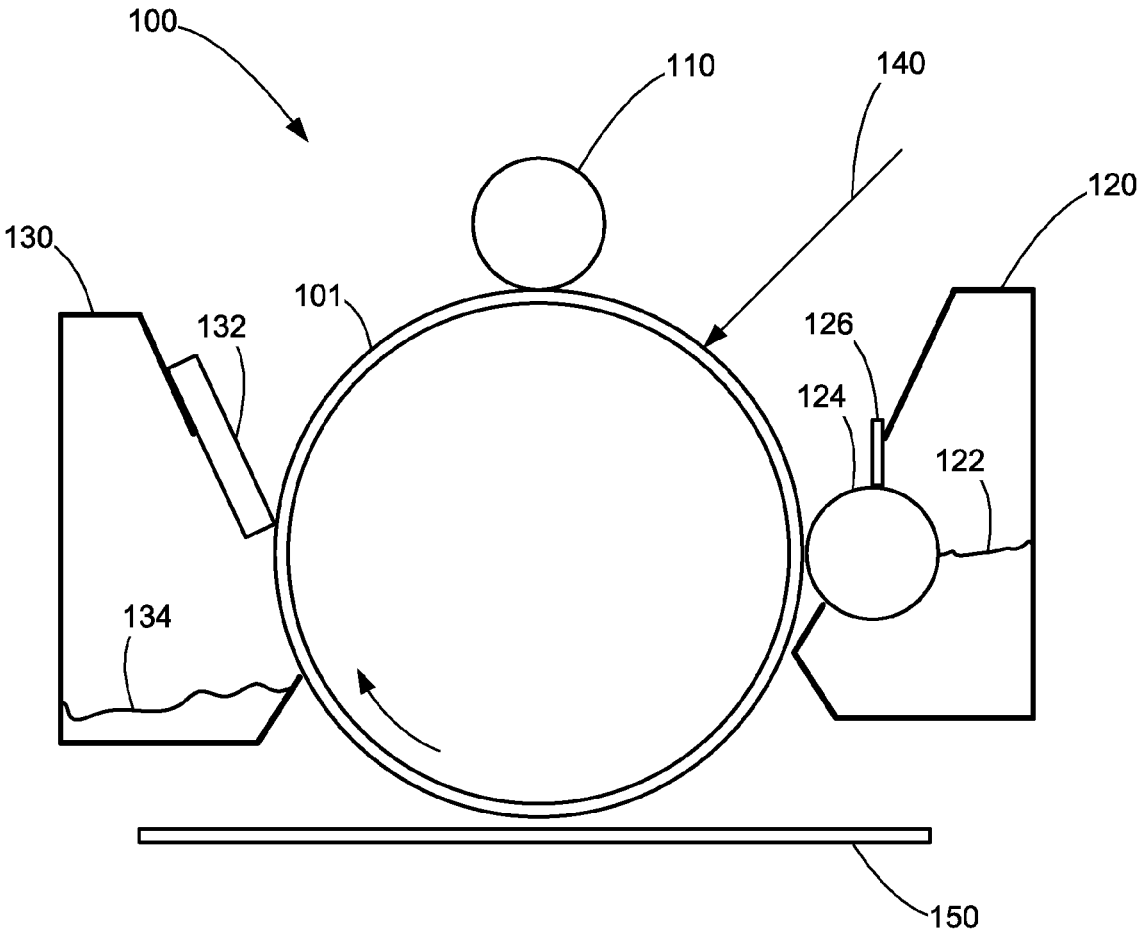
FIG. 1 is a schematic view of an electrophotographic image forming device according to one example embodiment.

FIG. 1 illustrates a schematic representation of an example electrophotographic image forming device 100. Image forming device 100 includes a photoconductive drum 101, a charge roll 110, a developer unit 120 and a cleaner unit 130. The electrophotographic printing process is well known in the art and, therefore, is described briefly herein. During a print operation, charge roll 110 charges the surface of photoconductive drum 101. The charged surface of photoconductive drum 101 is then selectively exposed to a laser light source 140 to form an electrostatic latent image on photoconductive drum 101 corresponding to the image being printed. Charged toner from developer unit 120 is picked up by the latent image on photoconductive drum 101 creating a toned image.

Developer unit 120 includes a toner reservoir 122 having toner particles stored therein and a developer roll 124 that supplies toner from toner reservoir 122 to photoconductive drum 101. Developer roll 124 is electrically charged and electrostatically attracts the toner particles from toner reservoir 122. A doctor blade 126 disposed along developer roll 124 provides a substantially uniform layer of toner on developer roll 124 for subsequent transfer to photoconductive drum 101. As developer roll 124 and photoconductive drum 101 rotate, toner particles are electrostatically transferred from developer roll 124 to the latent image on photoconductive drum 101 forming a toned image on the surface of photoconductive drum 101. In one embodiment, developer roll 124 and photoconductive drum 101 rotate in opposite rotational directions such that their adjacent surfaces move in the same direction to facilitate the transfer of toner from developer roll 124 to photoconductive drum 101. A toner adder roll (not shown) may also be provided to supply toner from toner reservoir 122 to developer roll 124. Further, one or more agitators (not shown) may be provided in toner reservoir 122 to distribute the toner therein and to break up any clumped toner.

The toned image is then transferred from photoconductive drum 101 to print media 150 (e.g., paper) either directly by photoconductive drum 101 or indirectly by an intermediate transfer member. A fusing unit (not shown) fuses the toner to print media 150. A cleaning blade 132 (or cleaning roll) of cleaner unit 130 removes any residual toner adhering to photoconductive drum 101 after the toner is transferred to print media 150. Waste toner from cleaning blade 132 is held in a waste toner reservoir 134 in cleaning unit 130. The cleaned surface of photoconductive drum 101 is then ready to be charged again and exposed to laser light source 140 to continue the printing cycle.

The components of image forming device 100 are replaceable as desired. For example, in one embodiment, developer unit 120 is housed in a replaceable unit with photoconductive drum 101, cleaner unit 130 and the main toner supply of image forming device 100. In another embodiment, developer unit 120 is provided with photoconductive drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductive drum 101 and cleaner unit 130 are provided in a second replaceable unit. In another embodiment, developer unit 120 is provided in a first replaceable unit, the main toner supply of image forming device 100 is provided in a second replaceable unit and photoconductive drum 101 and cleaner unit 130 are provided in a third replaceable unit. Further, any other combination of replaceable units may be used as desired.

Figure 2:
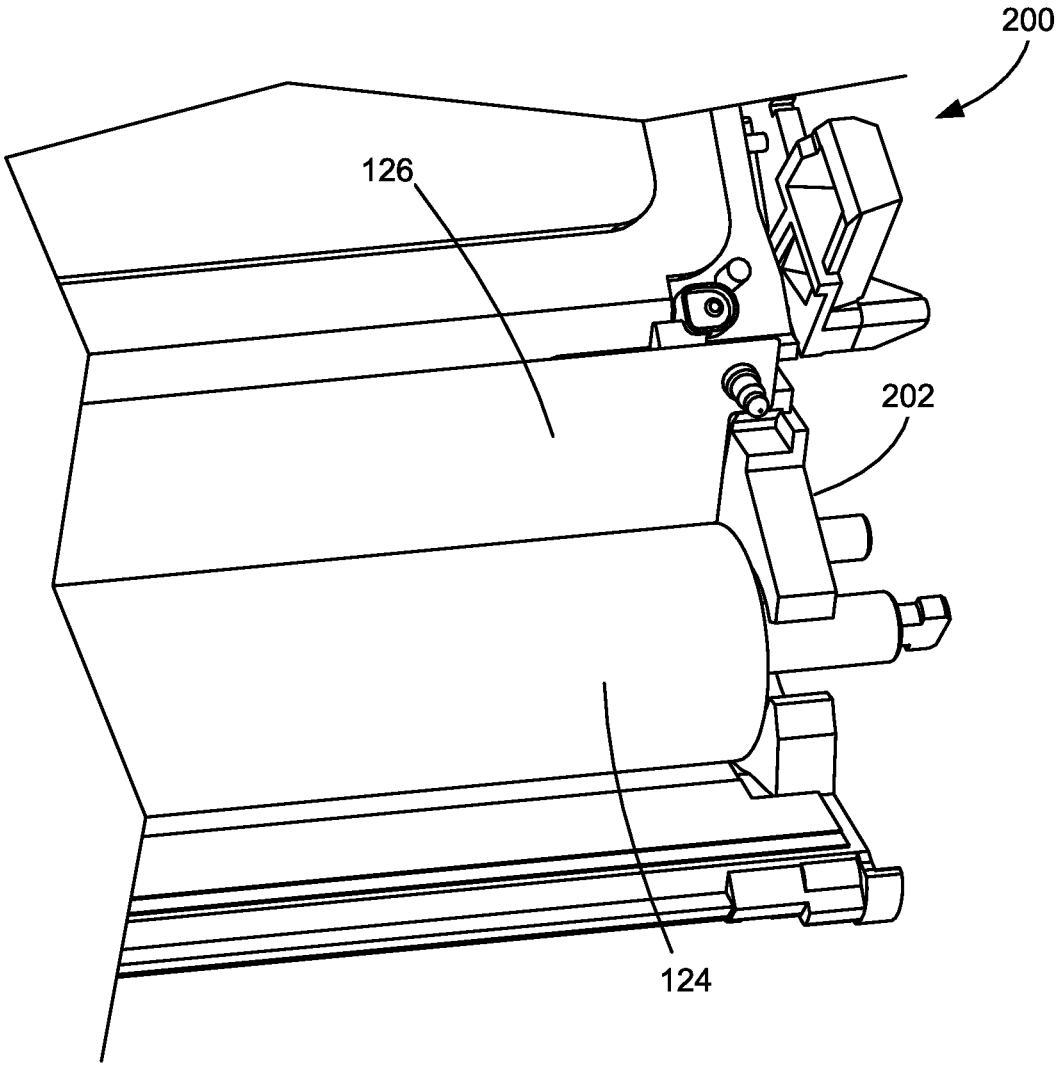
FIG. 2 is a perspective view of a portion of a developer unit of an electrophotographic image forming device according to one example embodiment.
Figure 3:
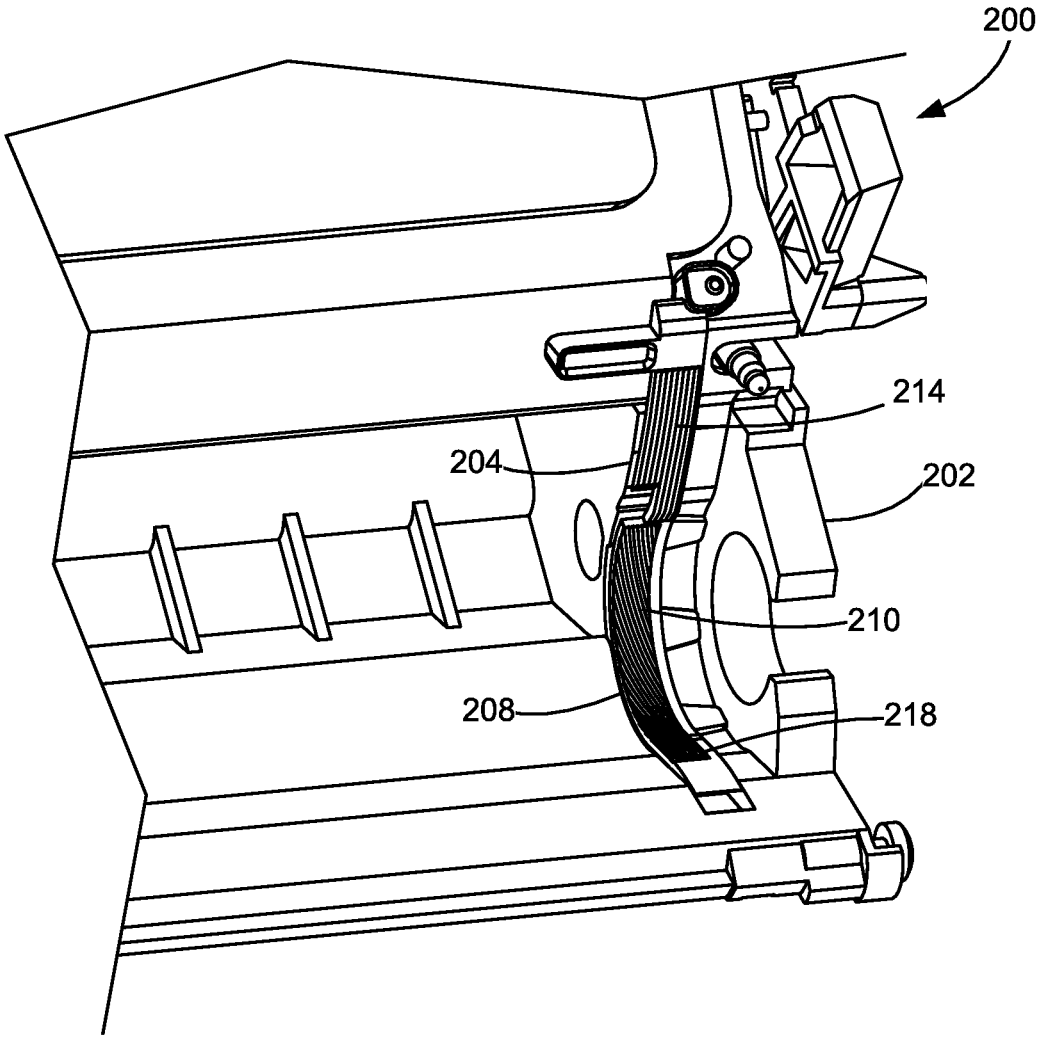
FIG. 3 is a perspective view of the developer unit shown in FIG. 2 with a developer roll and a doctor blade removed to show an end seal according to one example embodiment.
Figure 4:
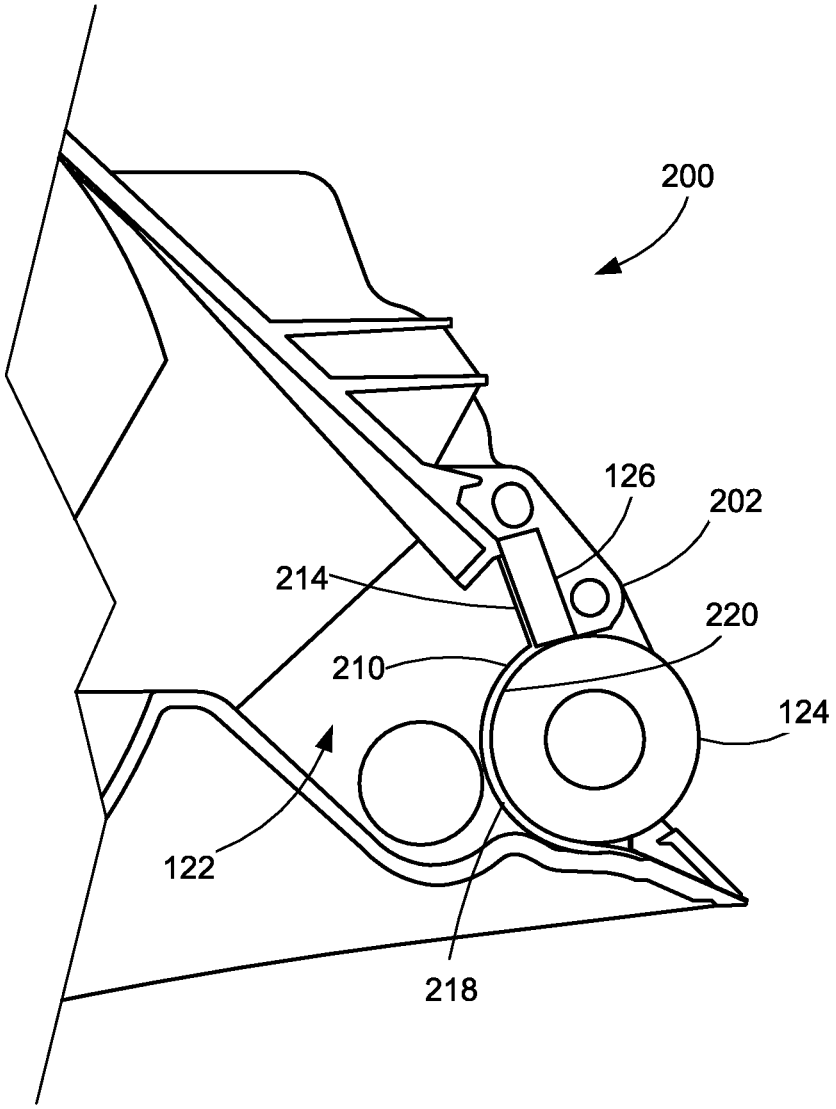
FIG. 4 is a sectional side view of the developer unit shown in FIGS. 2 and 3.

FIG. 2 illustrates an example replaceable unit 200 that includes developer unit 120. Replaceable unit 200 includes a housing 202 containing developer roll 124 and doctor blade 126 positioned against developer roll 124. FIG. 3 shows replaceable unit 200 with developer roll 124 and doctor blade 126 removed to more clearly illustrate the internal components of replaceable unit 200. FIG. 3 shows an example end seal 210 positioned in housing 202 at one axial end of developer roll 124. A second end seal (not shown) is positioned at the opposite axial end of developer roll 124 and may be a mirror image of end seal 210. A blade seal portion 214 of end seal 210 is compressed between an interface 204 formed in housing 202 and an end portion of doctor blade 126 (FIG. 2). A rotary seal portion 218 of end seal 210 is compressed between a curved interface 208 formed in housing 202 and an axial end portion of developer roll 124 (FIG. 2). FIG. 4 shows a side view of end seal 210 in housing 202 with a front face or sealing face 220 of end seal 210 positioned against developer roll 124 and doctor blade 126. As shown in FIG. 4, blade seal portion 214 of end seal 210 is positioned against a rear surface of doctor blade 126 and rotary seal portion 218 of end seal 210 is curved around and positioned against a rear surface of developer roll 124. End seal 210 may be described as J-shaped due to its substantially straight blade seal portion 214 and connecting curved rotary seal portion 218. End seal 210 prevents toner from leaking at the axial end of developer roll 124 at the interface between housing 202, developer roll 124 and doctor blade 126.

Figure 5A:
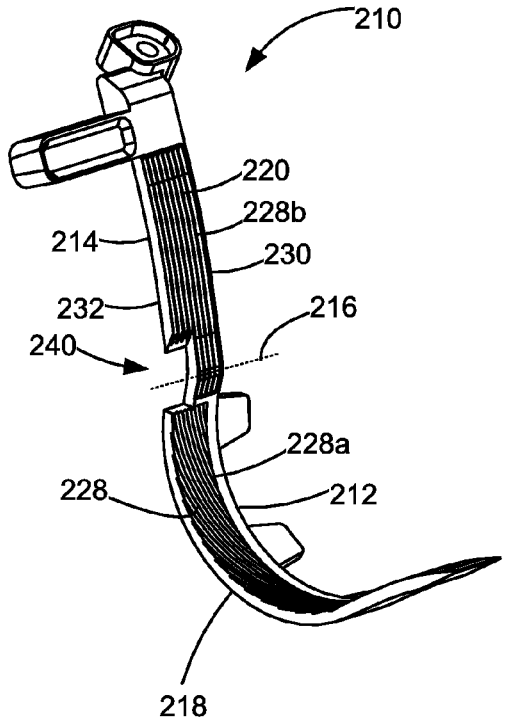
FIGS. 5A and 5B are a front perspective view and a rear perspective view, respectively, of the end seal having a cutout according to one example embodiment.
Figure 5B:
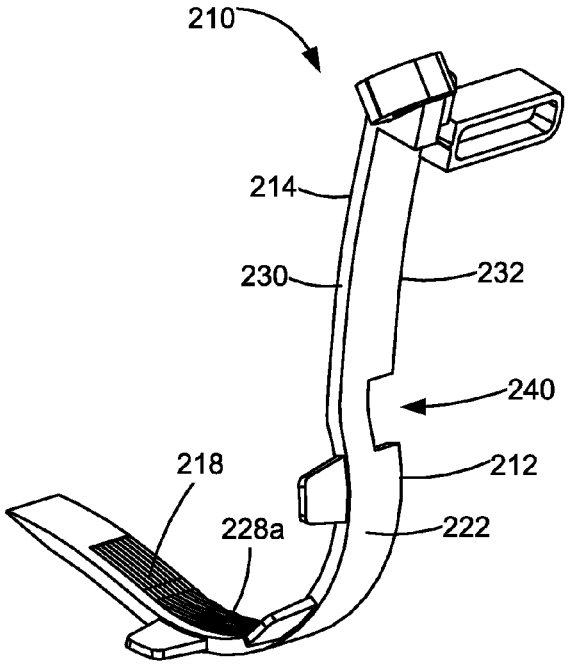

FIGS. 5A and 5B show an example end seal 210 in more detail. In some embodiments, end seal 210 includes a molded (e.g., injection molded or compression molded) body 212 made of a polymeric elastomeric material. One suitable example of an elastomeric material is SANTOPRENE™, a thermoplastic vulcanizate available from Exxon Mobil Corporation. In other embodiments, body 212 is composed of foam, felt or the like. End seal 210 includes an outer axial side 230 and an inner axial side 232 relative to developer roll 124. Sealing face 220 of end seal 210 includes grooves 228 therein to prevent the migration of toner axially outward past end seal 210. Grooves 228 may be formed between small ribs on sealing face 220 of end seal 210. Grooves 228*a* on sealing face 220 of rotary seal portion 218 may be angled to guide toner away from the axial end of developer roll 124 as developer roll 124 rotates against rotary seal portion 218. Grooves 228*a* are open at inner axial side 232 to allow developer roll 124 to push toner through grooves 228*a*, off of end seal 210 and back into toner reservoir 122 as developer roll 124 rotates. Grooves 228*b* on blade seal portion 214 may be vertically oriented as illustrated (parallel to a longitudinal dimension of end seal 210).

Figure 6:
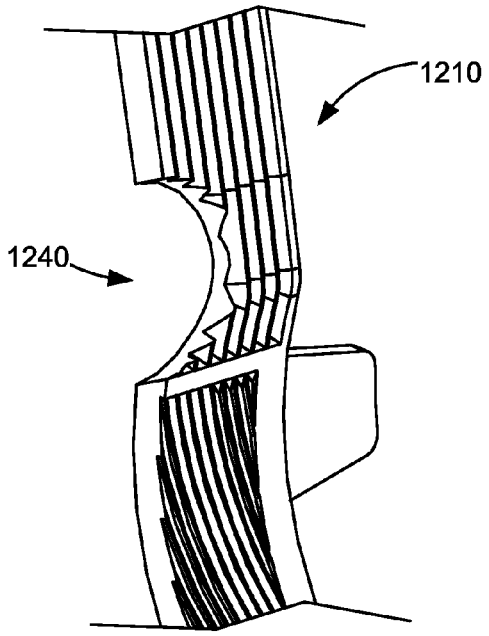
FIG. 6 is a front perspective view of a portion of the end seal having a cutout according to a second example embodiment.
Figure 7:
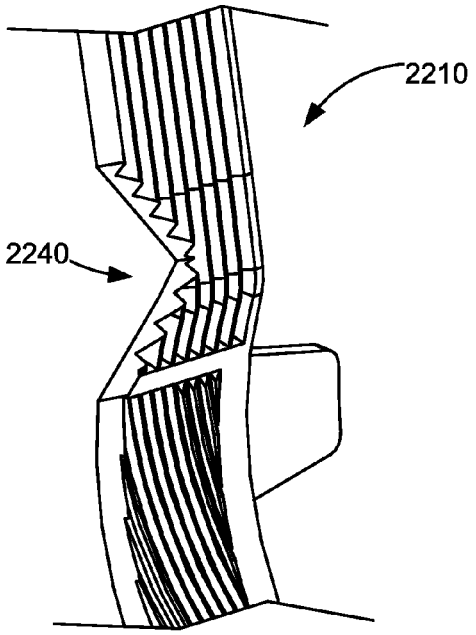
FIG. 7 is a front perspective view of a portion of the end seal having a cutout according to a third example embodiment.

End seal 210 includes a notch, indentation or cutout 240 therein on the inner axial side 232 of end seal 210. End seal 210 is preferably molded to a shape that includes cutout 240 therein when end seal 210 is formed; however, cutout 240 may also be formed by removing the area of cutout 240 from end seal 210 in a secondary operation. Cutout 240 is positioned at a point 216 where blade seal portion 214 and rotary seal portion 218 meet at the inner axial side 232 of end seal 210. In the embodiment illustrated, cutout 240 is positioned at the bottommost portion of blade seal portion 214 and the topmost portion of rotary seal portion 218 such that the bottommost portion of blade seal portion 214 and the topmost portion of rotary seal portion 218 have a smaller width in the axial dimension of developer roll 124 than the portion of blade seal portion 214 directly above cutout 240 and the portion of rotary seal portion 218 directly below cutout 240. In some embodiments, cutout 240 is taller than it is wide (i.e., a height of cutout 240 along a longitudinal dimension of end seal 210 is greater than a width of cutout 240 along the axial dimension of developer roll 124). In one example embodiment, cutout 240 is 2 mm wide by 4 mm high. In other embodiments, a height of cutout 240 along a longitudinal dimension of end seal 210 is equal to a width of cutout 240 along the axial dimension of developer roll 124. In other example embodiments, cutout 240 is 4 mm wide by 4 mm high or 2 mm wide by 2 mm high. However, cutout 240 may be narrower, wider, taller or shorter as desired. In the example embodiment illustrated, cutout 240 is rectangular in shape; however, cutout 240 may take any suitable shape (e.g., square, circular, oval, triangular, irregular, etc.). For example, FIG. 6 shows an end seal 1210 having a circular segment cutout 1240 and FIG. 7 shows an end seal 2210 having a triangular cutout 2240. In the embodiment illustrated, cutout 240 extends all the way through the material thickness or depth of end seal 210.

Figure 8:
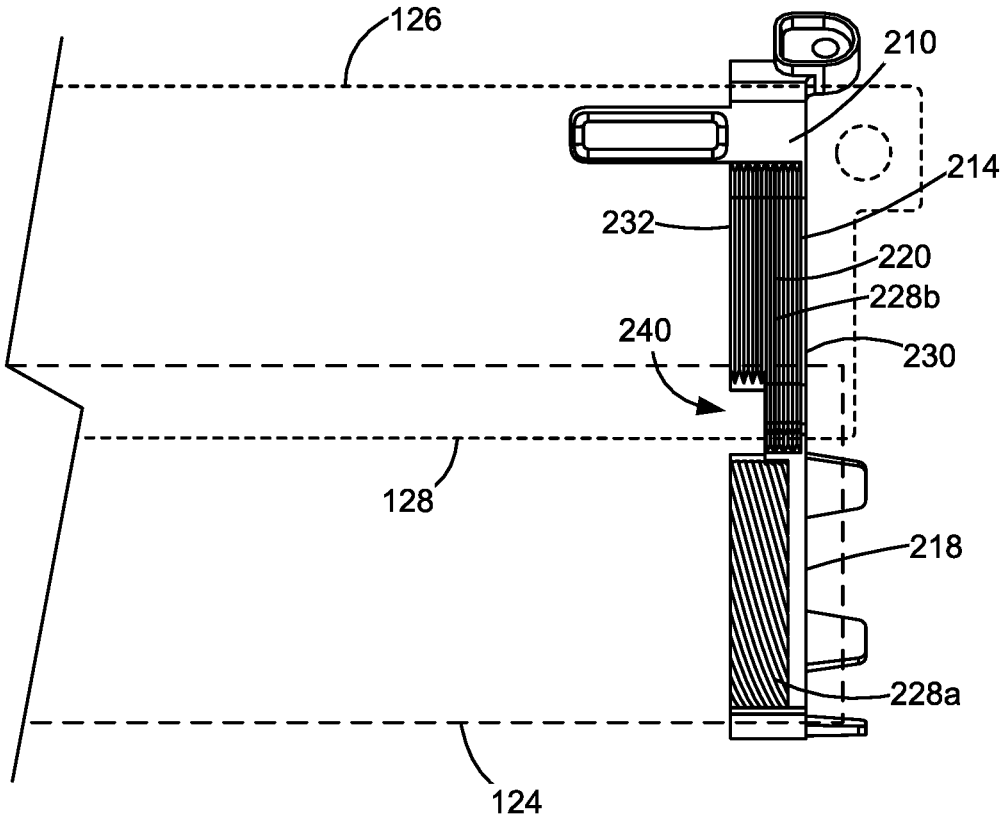
FIG. 8 is an elevation view of the end seal shown in FIGS. 5A and 5B schematically illustrating the positions of the developer roll and the doctor blade relative to the end seal according to one example embodiment.

FIG. 8 shows the positions of developer roll 124 and doctor blade 126 relative to end seal 210 schematically illustrated in dashed lines according to one example embodiment. In the embodiment illustrated, cutout 240 is positioned at the point where a free end 128 of doctor blade 126 contacts the outer surface of developer roll 124. In this embodiment, a bottom segment of doctor blade 126 including free end 128 of doctor blade 126 and a portion of the outer surface of developer roll 124 that free end 128 of doctor blade 126 contacts are positioned in front of end seal 210 in the area of cutout 240. In the embodiment illustrated, the axial ends of developer roll 124 and doctor blade 126 extend past outer axial side 230 of end seal 210.

During operation, toner may tend to accumulate in grooves 228*a* of rotary seal portion 218 over time as a result of inefficiencies in the sweeping or pushing of toner in grooves 228*a* by developer roll 124 as developer roll 124 rotates. Cutout 240 provides an additional exit path for toner to escape end seal 210 back into toner reservoir 122. Without cutout 240, the accumulation of toner may tend to create a stagnation point in grooves 228*a* that prevents developer roll 124 from pushing toner through grooves 228*a* and off of end seal 210, especially near the point where doctor blade 126 contacts and removes toner from developer roll 124. Over time, if enough toner builds up, the accumulated toner may push end seal 210 away from developer roll 124 creating a leakage path between end seal 210 and developer roll 124 and/or doctor blade 126. The additional toner exit path provided by cutout 240 reduces toner stagnation in the area where doctor blade 126 removes toner from developer roll 124, where the risk of toner stagnation is greatest. This, in turn, reduces the likelihood of end seal 210 pushing away from developer roll 124 thereby improving the sealing performance of end seal 210. It was found that the sealing performance of end seal 210 improved as the width of cutout 240 along the axial dimension of developer roll 124 increased. However, it is preferred that the width of end seal 210 along the axial dimension of developer roll 124 remain large enough in the area of cutout 240 (e.g., at least 1-2 mm) to maintain the structural stability of end seal 210. The inclusion of cutout 240 goes against conventional wisdom by effectively reducing the width of end seal 210 in the most critical region of end seal 210, at the doctor blade 126 and developer roll 124 interface. Typically, the effectiveness of an end seal such as end seal 210 is improved by increasing, rather than decreasing, the width of the seal.

In addition to improving the sealing performance of end seal 210, the inclusion of cutout 240 reduces the material cost of end seal 210. Further, if instead of including cutout 240, the width of end seal 210 were increased in the axial dimension of developer roll 124, the axial lengths of developer roll 124 and doctor blade 126 would also typically need to be increased in order to maintain the same amount of axial space available for toner on the surface of developer roll 124 to maintain the ability to print the desired page width. Increasing the axial lengths of developer roll 124 and doctor blade 126 typically increases the costs of these components. In some instances, increasing the size of developer roll 124 and doctor blade 126 may, in turn, require increasing the size of housing 202, contrary to consumer preferences for smaller components, which may also increase the cost of housing 202. Accordingly, the inclusion of cutout 240 may avoid the cost and size increases associated with increasing the width of end seal 210.

Figure 9A:
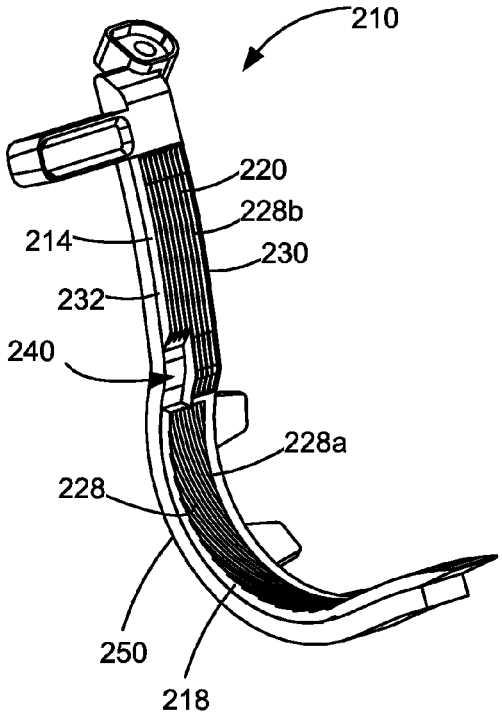
FIGS. 9A and 9B are a front perspective view and a rear perspective view, respectively, of the end seal shown in FIGS. 5A and 5B having a foam backing according to one example embodiment.
Figure 9B:
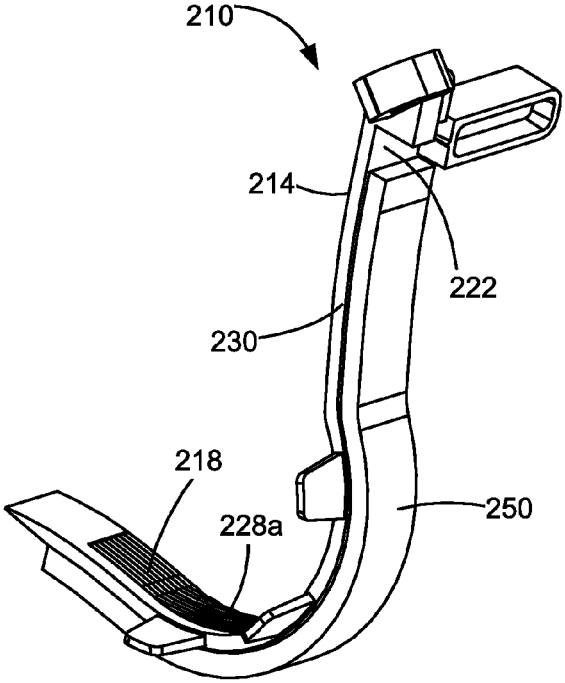

FIGS. 9A and 9B show end seal 210 having a foam backing 250 positioned against rear face 222 of end seal 210. In the embodiment illustrated, foam backing 250 is positioned against the rear face 222 of both blade seal portion 214 and rotary seal portion 218 of end seal 210. In some embodiments, foam backing 250 is positioned against rear face 222 of end seal 210 in the area of cutout 240 as illustrated. In other embodiments, foam backing 250 includes a corresponding notch or cutout in the area of cutout 240. In the embodiment illustrated, foam backing 250 is adhered to rear face 222 of end seal 210. In other embodiments, foam backing 250 is sandwiched between rear face 222 of end seal 210 and housing 202 and may be adhered to housing 202. Foam backing 250 biases end seal 210 toward the outer surface of developer roll 124 and the rear side of doctor blade 126 when foam backing 250 is compressed between end seal 210 and housing 202. The bias applied to end seal 210 by foam backing 250 aids in holding sealing face 220 against developer roll 124 and doctor blade 126 in order to provide sufficient sealing contact of end seal 210 against developer roll 124 and doctor blade 126. While the example end seal 210 is biased against developer roll 124 and doctor blade 126 by foam backing 250, it will be appreciated that the bias toward developer roll 124 and doctor blade 126 may be applied by any suitable method. For example, in another embodiment, end seal 210 includes one or more ridges, beams or ribs molded onto rear face 222 that resiliently compress against housing 202 to bias end seal 210 against developer roll 124 and doctor blade 126. In another embodiment, end seal 210 includes one or more intermediate springs or resilient members that are compressed between rear face 222 of end seal 210 and housing 202 to bias end seal 210 against developer roll 124 and doctor blade 126.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An end seal for an electrophotographic image forming device, comprising:

an elastomeric body having a blade seal portion for sealing against a rear surface of a doctor blade and a curved rotary seal portion that extends from a bottom end of the blade seal portion for sealing against an outer surface of a rotatable developer roll; and a cutout in an inner axial side of the body, the cutout is positioned at a bottommost portion of the blade seal portion and a topmost portion of the rotary seal portion such that the bottommost portion of the blade seal portion and the topmost portion of the rotary seal portion have a smaller width across a sealing face of the end seal than a portion of the blade seal portion directly above the cutout and a portion of the rotary seal portion directly below the cutout.

2. The end seal of claim 1, wherein the sealing face of the blade seal portion includes a plurality of grooves that run along a longitudinal dimension of the body and the sealing face of the rotary seal portion includes a plurality of grooves that run transverse to the longitudinal dimension of the body.

3. The end seal of claim 1, wherein the cutout has a rectangular cross-sectional shape.

4. The end seal of claim 1, wherein the cutout has a partial circular cross-sectional shape.

5. The end seal of claim 1, wherein the cutout has a triangular cross-sectional shape.

6. The end seal of claim 1, wherein a height of the cutout along a longitudinal dimension of the body is greater than a width of the cutout across the sealing face of the end seal.

7. An end seal for an electrophotographic image forming device, comprising:

an elastomeric body having a blade seal portion shaped to seal against a planar rear surface of a doctor blade and a curved rotary seal portion that extends from a bottom end of the blade seal portion and is shaped to seal against an outer surface of a rotatable developer roll; and a cutout through the body at an inner axial side of the body, the cutout is positioned at a bottommost portion of the blade seal portion and a topmost portion of the rotary seal portion such that the bottommost portion of the blade seal portion and the topmost portion of the rotary seal portion have a smaller width across a sealing face of the end seal than a portion of the blade seal portion directly above the cutout and a portion of the rotary seal portion directly below the cutout.

8. The end seal of claim 7, wherein the sealing face of the blade seal portion includes a plurality of grooves that run along a longitudinal dimension of the body and the sealing face of the rotary seal portion includes a plurality of grooves that run transverse to the longitudinal dimension of the body.

9. The end seal of claim 7, wherein the cutout has a rectangular cross-sectional shape.

10. The end seal of claim 7, wherein the cutout has a partial circular cross-sectional shape.

11. The end seal of claim 7, wherein the cutout has a triangular cross-sectional shape.

12. The end seal of claim 7, wherein a height of the cutout along a longitudinal dimension of the body is greater than a width of the cutout across the sealing face of the end seal.

13. A developer unit for an electrophotographic image forming device, comprising:

a housing;

a developer roll mounted on the housing, the developer roll is rotatable relative to the housing about an axis of rotation, the developer roll includes an outer surface;

a doctor blade mounted on the housing, a free end of the doctor blade is in contact with the outer surface of the developer roll along an axial dimension of the developer roll; and an end seal having a body, the body having a blade seal portion sandwiched between a first interface of the housing and a rear surface of the doctor blade at an end of the doctor blade, the body having a curved rotary seal portion sandwiched between a second interface of the housing and an outer surface of the developer roll at an axial end of the developer roll, the body has an inner axial side and an outer axial side relative to the developer roll, the end seal includes a cutout in the inner axial side of the body, the cutout is positioned at a point where the free end of the doctor blade contacts the outer surface of the developer roll, the cutout is positioned at a bottom segment of the doctor blade including the free end of the doctor blade and at a portion of the outer surface of the developer roll adjacent where the free end of the doctor blade contacts the outer surface of the developer roll such that a width of the blade seal portion of the end seal in contact with the doctor blade along an axial dimension of the developer roll at the bottom segment of the doctor blade is less than a width of the blade seal portion of the end seal in contact with the doctor blade along the axial dimension of the developer roll directly above the bottom segment of the doctor blade and a width of the rotary seal portion of the end seal in contact with the outer surface of the developer roll along the axial dimension of the developer roll at the portion of the outer surface of the developer roll adjacent where the free end of the doctor blade contacts the outer surface of the developer roll is less than a width of the rotary seal portion of the end seal in contact with the outer surface of the developer roll along the axial dimension of the developer roll directly below the portion of the outer surface of the developer roll adjacent where the free end of the doctor blade contacts the outer surface of the developer roll such that the cutout forms an exit path for toner to escape the end seal at the bottom segment of the doctor blade and at the portion of the outer surface of the developer roll adjacent where the free end of the doctor blade contacts the outer surface of the developer roll.

14. The developer unit of claim 13, wherein a sealing face of the blade seal portion includes a plurality of grooves that run along a longitudinal dimension of the body of the end seal and a sealing face of the rotary seal portion includes a plurality of grooves that run transverse to the longitudinal dimension of the body of the end seal.

15. The developer unit of claim 13, wherein the cutout has a rectangular cross-sectional shape.

16. The developer unit of claim 13, wherein the cutout has a partial circular cross-sectional shape.

17. The developer unit of claim 13, wherein the cutout has a triangular cross-sectional shape.

18. The developer unit of claim 13, wherein a height of the cutout along a longitudinal dimension of the body of the end seal is greater than a width of the cutout along the axial dimension of the developer roll.

* * * * *